United States Patent [19]

Delourme et al.

[11] Patent Number: 4,526,696

[45] Date of Patent: Jul. 2, 1985

[54] FLOTATION OF MINERALS

[75] Inventors: Raymond Delourme, Billere; Jean-Louis Detienne, Pau; Jacques Komornicki, Lescar; Jacques Tellier, Lons, all of France

[73] Assignee: Societe Nationale Elf Aquitaine (Production), France

[21] Appl. No.: 541,560

[22] Filed: Oct. 13, 1983

[30] Foreign Application Priority Data

Oct. 13, 1982 [FR] France ..... 82 17127

[51] Int. Cl.[3] ..... C22B 3/00; B03D 1/02

[52] U.S. Cl. ..... 252/61; 252/49.5; 252/309; 252/351

[58] Field of Search ..... 252/49.5, 61, 309, 351

[56] References Cited

U.S. PATENT DOCUMENTS

| | | | |
|---|---|---|---|
| 1,774,183 | 8/1930 | Moses et al. | 252/61 |
| 2,027,357 | 1/1936 | Moses et al. | 252/61 |
| 2,163,702 | 6/1939 | Ried | 252/61 |
| 2,302,338 | 11/1942 | Moeller et al. | 252/61 |
| 2,610,738 | 9/1952 | Cuthbertson | 252/61 |
| 3,309,352 | 3/1967 | Young et al. | 252/61 |
| 3,456,791 | 7/1969 | Ramirez | 252/61 |
| 4,012,329 | 3/1977 | Hayes et al. | 252/309 |
| 4,211,644 | 7/1980 | Wiechers | 252/61 |
| 4,274,950 | 6/1981 | Larribau et al. | 252/61 |

*Primary Examiner*—Paul Lieberman
*Assistant Examiner*—Robert A. Wax
*Attorney, Agent, or Firm*—Ostrolenk, Faber, Gerb & Soffen

[57] ABSTRACT

Process of flotation of minerals, which consists of introducing the flotation collector into the mineral pulp to be treated in the form of a microemulsifiable composition. In general, the collector agents are organic compounds containing sulphur, particularly mercaptans, thioethers or polysulphides, which generally are very slightly soluble in water. This process is particularly suitable for minerals based on oxides and sulphides.

12 Claims, No Drawings

FLOTATION OF MINERALS

The present invention relates to an improvement in the flotation of minerals, particularly minerals based on oxides and sulphides. It relates more particularly to the utilization for flotation of organic compounds which are slightly soluble or insoluble in water; such collectors are found particularly among thio-organic compounds. Thus, the invention envisages a process of flotation utilizing collectors which are slightly or non-hydrosoluble; it comprises new collectors of this type, as well as a composition containing the flotation collectors.

Flotation, at present the standard process for the separation and concentration of various minerals, is well known and it is thus not necessary to explain it here. It will merely be recalled that this method is extremely useful for the enrichment of low content minerals before their treatment by pyrometallurgy or hydrometallurgy; for example, this is the case with oxide and/or sulphide minerals of lead, zinc, copper, molybdenum etc. Various collectors are known which are currently employed, such as alkali metal xanthates having lower alkyl chains, particularly potassium ethyl or amyl xanthate, mercapto-benzo-thiozols, dithiocarbamates, thiocarbamates and dithiophosphates. These compounds are sufficiently soluble in water that they can be added directly to the mineral pulp to be treated. However, there are compounds which can be very efficacious as flotation collectors, but which have a solubility in water which is too low for these products to be capable of giving good results. This is the case, for instance, with mercaptans containing more than 8 carbon atoms in the hydrocarbon chain and xanthates of alkyl groups containing more than 6 carbon atoms, which would be interesting to use because of their very strong selectivity. Attempts have thus been made, in the prior art, to solubilize such compounds, so that they can better serve as flotation collectors. Thus, U.S. Pat. No. 4,211,644, which describes the use as collectors of $C_{12}$ or higher alkyl mercaptans, recommends the addition of a polyglycol in order to moisten and/or emulsify the mercaptan, which is too slightly soluble in water. If this solution leads to some progress, it is only partial. In fact according to this patent, the solubilizing agent must itself be soluble in water, which limits the range of products which can be utilized.

In this connection, the present invention provides a substantial improvement: it renders possible the utilization of certain collectors which are insufficiently soluble or practically insoluble in water, to give excellent results all the same, while also giving the desired selectivity.

The new process according to the invention consists on introducing the flotation collector into the mineral pulp to be treated in the form of a microemulsifiable composition.

The new flotation composition according to the invention is thus characterized by comprising the collector, a surfactant compound, a co-surfactant and if required water, the whole being dilutable with water from the pulp to be treated, with the formation of a microemulsion.

As the microemulsions according to the invention are of the oil-in-water type, the co-surfactant cannot be soluble in the water, in contrast to adjuvants of the polyglycol type recommended by the prior art, as mentioned above.

As well known, microemulsions are systems which are very different from emulsions: their definition is known in the art and it is thus not necessary to mention it here (P. A. Winsor, Trans. Faraday Soc. 1948-44-376).

Collector agents to which the present invention applies particularly well are, in general, organic compounds containing sulphur, particularly mercaptans, thioethers, polysulphides etc. Thus the invention allows substantial improvement in the collector effect of mercaptans having more than 8 carbon atoms and especially $C_{12}$ to $C_{18}$, that is mercaptans which are very slightly soluble in water. An equal improvement is obtained when using organic sulphides of the R—S—R′ type, in which R and R′ are the same or different and represent $C_1$ to $C_{24}$ hydrocarbon groups; those of these compounds in which R′ carries an —OH, —SH, —COOR″, —CSOR″ or CSSR″ group, R″ being H, a cation or a $C_1$ to $C_{18}$ hydrocarbyl group, are suitable by themselves as good collectors, as shown by French Patent Application No. 2429617, but they give even better results when utilized in the form of a microemulsion, in accordance with the present invention. Another type of collector, giving excellent results according to the present invention, are polysulphides $R—S_x—R'$, where R and R′ have the same meaning as above, while x has average values of the order of 2 to 8 and preferably 3 to 5; these polysulphides are new flotation agents which are mainly of interest when they are in microemulsion form.

Although all the thiocompounds indicated above are beneficial, as flotation collectors in the application of the microemulsion process according to the invention, reference is made below by way of non-limitative example to various utilizable compounds.

Alkyl mercapto-esters, $HS(CH_2)_nCOOR$, where n is 1 or 2 and R is a $C_1$ to $C_{12}$ alkyl group; when R is a heptyl or octyl group, particularly 2-ethyl-hexyl, these compounds which are very soluble in water are excellent collectors, particularly for chalcopyrite. Their homologues of higher molar weight are less soluble and become of interest when employed as microemulsions.

Di-hexyl and di-octyl sulphides

The sulphides $C_{10}H_{21}SCH_3$, $C_{12}H_{25}SCH_3$ and $C_{14}H_{29}SCH_3$ give excellent results with chalcopyrite, galena, blende and pyrites in the standard method and their homologues with heavier alkyls in place of the $CH_3$ group are suitable as microemulsions. The same holds for the alkyl-2-thioacetic acids, $RSCH_2COOH$, which give excellent results in the ordinary way when R is $C_{12}$ to $C_{16}$ and are particularly suitable as microemulsions for heavier branched R groups. When the acidic group in the sulphides is esterified, the standard manner is still very suitable for the methyl and ethyl esters, while for esters of higher alcohols, particularly $C_4$ to $C_{12}$, it is preferable to employ the collector as a microemulsion.

As regards the polysulphides $R—S_x—R$ or $R—S_x—R'$, good results are given, without it being necessary to form them into microemulsions, provided their molecular weight and sulphur content do not exceed certain limits. For example, di-hexyl trisulphide, $C_6H_{13}SSSC_6H_{13}$, as well as di-hexyl pentasulphide, are good collectors for chalcopyrite and galena, but the results are better when they are employed as microemulsions; for polysulphides of higher molecular weight, the improvement using the microemulsion form becomes very marked.

The particularity of the flotation collector compositions according to the invention lies in that the liquid phase associated with the collector per se is constituted by a surfactant which is liquid or is at least dissolved in a small quantity of appropriate solvent. Preferred surfactants are nonionic compounds which can be selected from various known classes; for example, they are, polyoxyalkylenes which can carry various groups, corresponding to the general formula:

$$R-(O-R^1)_n-OH \quad (1),$$

where R can be a $C_1$ to $C_{30}$ alkyl, preferably $C_6$ to $C_{18}$; an aryl or substituted aryl group, preferably carrying a $C_1$ to $C_{18}$ linear alkyl group, most preferably $C_6$ to $C_{12}$; a heterocyclic or cycloalkyl group or possibly a hydrogen atom; $R^1$ designates an alkylene, generally linear and preferably $C_1$ to $C_6$; n is an integral number from 1 to 12 and preferably from 2 to 6. Compounds most commonly available industrially, corresponding to formula (1), are polyoxyethylenes and alkyl-phenyl-polyoxyethylenes, known commercially under the names "SIMULSOL" and "TRITON X".

Polyoxyethylenes can also be utilized in the form of their addition products with esters of sorbitan, known under the name "TWEEN". Other useful surfactant compounds are esters or ethers of polyoxyalkylenes of formula (1), such as the laurates, stearates, oleate or ricinoleate of a polyoxyethylene, possibly carrying an alkyl-phenyl group. Polyoxyalkylene thioethers can equally be used, namely compounds in which the first oxygen in formula (1) has been replaced by sulphur; this is the case, for example, with tertiary deodecyl-monothioether and dodeca-ethylene glycol. Surfactants of the alkyl-glucoside type are also suitable.

The liquid surfactants indicated above are nonionic compounds, which appear to be the best. However, it is also possible to employ anionic or cationic surfactants, when the pH desired for the pulp treated by flotation permits this. Thus, the invention can be carried out by using collector compounds mixed in advance, in liquid form, with surfactants constituted by petroleum sulphonates or fatty alcohol sulphates, which are anionic, or alkylolamides, fatty amines or quaternary ammonium compounds, which are cationic.

When the surfactant is solid or viscous, it is always possible to form a liquid medium by the addition of a little water or a third solvent, such as a mono- or polyol; moreover, the co-surfactant can suffice to render the medium liquid.

As indicated above in the definition of the invention, the composition according to the invention comprises a third constituent, namely a co-surfactant. The nature and role of this agent are known in the art: it is sufficient, in order to carry out the invention, to select one or more co-surfactants from those which have been described in the prior art. Mention will merely be made of the fact that the agents in question are organic molecules having a lipophilic part and at least one polar group; for example, they are alcohols, generally $C_3$ or higher, alkylene-glycols, particularly ethylene, propylene, butylene or hexylene-glycol; these compounds can be linear or branched. Also suitable as co-surfactants are alkyl ethers and esters of glycol, ketones, fatty acid esters, that is, more than $C_4$ and preferably from $C_6$ to $C_{18}$, primary, secondary and tertiary amines, preferably with more than 4 carbon atoms, urea and its derivatives, etc. For economical reasons, various alcohols, more particularly $C_3$ to $C_8$ alcohols are those usually employed. Solubility of the co-surfactant in water is not necessary in the case of the present invention.

While the principle of the invention resides in making a microemulsion of the compound which is to serve as the flotation collector, it can be seen that the proportions of the constituents must be such that the microemulsion can form. In other words, the nature and proportions of the collector, the surfactant compounds and the co-surfactant agent are selected in such a way that the mixture obtained is stable, optically isotropic, homogeneous and dilutable with water. When dilution is effected, a microemulsion or an expanded micellar solution of the collector in water forms, which corresponds to an extremely fine dispersion of the collector; thus, even with substances insoluble in water employed as the collector, they become dispersed in a very fine manner in the pulp at the time of use.

The compositions according to the invention can be anhydrous, but it is possible to add to them a certain quantity of water to facilitate handling.

While the proportions of the three constituents defined above vary according to the nature of these constituents, mention can be made—by way of non-limitative example—of the following approximate proportions for compositions which are practically free from water:

| | |
|---|---|
| thiocompound (collector) | 30 to 60% by weight |
| surfactant liquid | 20 to 55% by weight |
| co-surfactant | 5 to 30% by weight |

In the case of aqueous compositions, there can be, for example:

| | |
|---|---|
| collector | 15 to 30% by weight |
| surfactant | 8 to 30% by weight |
| co-surfactant | 2 to 30% by weight |
| water | 50 to 70% by weight |

The compositions according to the invention can also contain other substances, for example wetting agents. These are suitable for various modes of flotation, particularly primary flotation, secondary etc.

The invention is illustrated by the following non-limitative examples.

EXAMPLE 1

A first series of flotation tests is effected using a sulphide mineral of copper derived from the South African mine at Palabora, having a copper content of 0.45 to 0.48%.

600 g of this mineral is ground to a fineness such that 76% of the powder passes through a screen having 148 micron meshes.

The product is subjected to flotation for 20 minutes at pH 7.5 in a 2.5 liter laboratory cell of the MINIMET M 130 type, in the presence of methyl-isobutyl-carbinol (MIBC) as a wetting agent, added in the proportion of 25 g per tonne of mineral.

The collector under test is n-dodecyl-mercaptan, which is introduced into the pulp in four different ways, as indicated below.

| | |
|---|---|
| ME | Introduction in the form of a composition which gives rise to the formation of a microemulsion, when added |

-continued

| | | |
|---|---|---|
| | to the mineral pulp. | |
| | This composition comprises by weight: | |
| | n.dodecyl-mercaptan | 52% |
| | nonyl-phenol-heptaoxyethylene (SIMULSOL 730) | 38.4% |
| | co-surfactant: isopropanol | 4.8% |
| | + 2-ethyl-hexanol | 4.8% |
| E1 | Introduction in the form of a standard emulsion having the composition, by weight: | |
| | n.dodecyl-mercaptan | 57.5% |
| | nonyl-phenol-polyoxyethylene | 42.5% |
| | This corresponds to the same mercaptan/surfactant ratio as in the previous ME mixture. | |
| E2 | In the form of a standard emulsion: | |
| | n-dodecyl-mercaptan | 80% |
| | decaoxy-ethylenated polyols | 20% |
| E3 | Emulsion: | |
| | n-dodecyl-mercaptan | 90% |
| | heptaoxyethylenated tert.-dodecyl-mercaptan | 3.2% |
| | dioxyethylenated tert.-dodecyl-mercaptan | 4.8% |
| | isopropanol | 2.0% |

Table 1 below gives the results of these flotation tests. The second vertical column of the Table indicates the quantities of n-dodecyl-mercaptan utilized: firstly, in grams per tonne of mineral, g/T, and then, in parentheses, in moles per tonne.

TABLE 1

| Method of introduction | Quantity of collector g/T | mol/T | Cu content of dry concentrate % | % of Cu recovered |
|---|---|---|---|---|
| ME | 35 | (0.173) | 3.8 | 79.5 |
| ME | 25 | (0.124) | 10.8 | 69.5 |
| ME | 15 | (0.074) | 10.6 | 50.8 |
| E1 | 35 | (0.173) | 10.4 | 30.4 |
| E2 | 35 | (0.173) | 5.4 | 15.5 |
| E3 | 35 | (0.173) | 10.4 | 50.8 |

As can be seen, recovery of the Cu is considerably increased when the ME method, namely introduction of the collector in a microemulsifiable form, is employed.

With equal quantities of collector, the emulsion processes E1 and E2, corresponding to the prior art, give much poorer results than the microemulsion method.

EXAMPLE 2

The operations are the same as in Example 1, except that the n-dodecyl-mercaptan is replaced by tert.-dodecyl-mercaptan as the collector. The latter has been utilized in three different forms:

| | | |
|---|---|---|
| ME | Microemulsifiable collector | |
| | tert.-dodecyl-mercaptan | 52% |
| | polyoxyethylenated nonyl-phenol | 38.4% |
| | isopropanol | 4.8% |
| | 2-ethyl-hexanol | 4.8% |
| E1 | Ordinary Emulsion: | |
| | tert.dodecyl-mercaptan | 57.5% |
| | nonyl-phenol-heptaoxyethylene | 42.5% |
| E2 | Emulsion: | |
| | tert.-dodecyl-mercaptan | 90% |
| | tert.-dodecyl-mercaptan-heptaoxyethylene | 3% |
| | tert.-dodecyl-mercaptan-dioxyethylene | 7% |

Table 2, analogously to the foregoing, gives the results obtained:

TABLE 2

| Method of introduction | Quantity of collector g/T | mol/T | Cu content of dry concentrate % | % of Cu recovered |
|---|---|---|---|---|
| ME | 35 | (0.173) | 11.4 | 75.8 |
| ME | 25 | (0.124) | 19.1 | 57.8 |
| E1 | 35 | (0.173) | 9.4 | 61.0 |
| E2 | 35 | (0.173) | 9.8 | 43.4 |

As in the foregoing Example, it can be seen that the same collector gives much better results when introduced in a form producing a microemulsion (ME).

EXAMPLE 3

Flotation tests similar to those of the foregoing Examples are effected with, as collector, di-tert.-dodecyl-pentasulphide. The three modes of introduction are the same as in Example 2.

| | | |
|---|---|---|
| ME | Microemulsifiable collector. | |
| | di-tert.-dodecyl-pentasulphide | 52.0% |
| | nonyl-phenol heptaoxyethylene | 38.4% |
| | isopropanol | 4.8% |
| | 2-ethyl-hexanol | 4.8% |
| E1 | Ordinary emulsion: | |
| | di-tert.-dodecyl-pentasulphide | 57.5% |
| | nonyl-phenol heptaoxyethylene | 42.5% |
| E2 | Emulsion: | |
| | di-tert.-dodecyl-pentasulphide | 90% |
| | tert.-dodecyl-mercaptan hepta-oxyethylene | 2% |
| | tert.-dodecyl-mercaptan dioxyethylene | 1.33% |
| | isopropanol | 6.67% |

TABLE 3

| Method of introduction | Quantity of collector g/T | mol/T | Cu content of dry concentrate % | % of Cu recovered |
|---|---|---|---|---|
| ME | 86 | (0.173) | 15.8 | 73.7 |
| ME | 61.7 | (0.124) | 15.9 | 64.6 |
| E1 | 86 | (0.173) | 14.5 | 66.7 |
| E1 | 61.7 | (0.124) | 13.3 | 48.0 |
| E2 | 86 | (0.173) | 5.3 | 21.3 |

The advantage of effecting introduction of the collector in a microemulsifiable form is confirmed by these results.

EXAMPLE 4

The tests of Example 3 are repeated with di-tert.-dodecyl-trisulphide in place of the pentasulphide. For the microemulsifiable collector, the proportions of the two alcohols are modified: isopropanol 6.25%, 2-ethyl-hexanol 3.35%. The results are set out in Table 4.

TABLE 4

| Method of introduction | Quantity of collector g/T | mol/T | Cu content of dry concentrate % | % of Cu recovered |
|---|---|---|---|---|
| ME | 75 | (0.173) | 14.6 | 58.1 |
| ME | 53.8 | (0.124) | 19.2 | 57.0 |
| E1 | 75 | (0.173) | 13.7 | 20.5 |
| E2 | 75 | (0.173) | 3.0 | 11.0 |

As with the pentasulphide, the results are much better when the trisulphide is introduced in the form of a composition which gives a microemulsion in the pulp.

EXAMPLE 5

In a flotation test similar to those of Example 3, the ME operation is repeated, replacing the di-tert.-dodecyl-pentasulphide with di-tert.-nonyl-pentasulphide, all the other conditions being as before.

With a quantity of the collector of 71.6 g/T, namely 0.173 mole per tonne of mineral, a copper content in the concentrate of 15.8% is obtained and the copper recovery is 65.2%. It can thus be seen that the change in the alkyl groups in the pentasulphide slightly modifies the percentage recovery and does no change the copper content in the concentrate, this content being higher than in the operations utilising a simple emulsion (E1 and E2 tests).

EXAMPLE 6

The flotation test of Example 4 ME at 0.173 mole per tonne of collector is repeated with di-tert.-nonyl-trisulphide in place of the di-tert.-dodecyl trisulphide. The result obtained is even better than in Table 4 above, as a copper content in the concentrate of 16.4% is given and a percentage of Cu recovered of 59.9.

EXAMPLE 7

Under the same conditions as in Examples 3 to 6, for the same mineral, flotation tests are effected with, as the collector, potassium amyl-xanthate, which is commonly used in this technique. This agent is introduced into the pump in the usual manner, namely in the form of its aqueous solution. The following results are obtained:

| Quantity of collector | | Cu content of dry concentrate | % of Cu |
|---|---|---|---|
| g/T | mole/T | % | recovered |
| 35 | 0.173 | 10.4 | 80 |
| 30 | 0.149 | 10.4 | 72 |
| 25 | 0.124 | 10.3 | 56.7 |

This shows that, while the xanthate permits a higher recovery of Cu, it provides concentrates, in contrast, which have a copper content which is much lower than that obtained with the microemulsified polysulphides. By comparing the 10.3 to 10.4% copper content in the concentrate obtained with the xanthate with the 14.6 to 16.4% given in the ME tests of Examples 3 to 6, it can be seen that the process according to the invention is capable of increasing by about 50% the concentration of the desired metal in the flotation product, which constitutes a considerable improvement.

EXAMPLE 8

Flotation tests are effected in an analogous manner to that of the foregoing tests, but using a sulphided lead-zinc mineral derived from the Pyrenean mine at NERBIOU. This mineral contains 4.8% of lead and 12.1% of zinc.

500 g are ground until 90% passes through a screen having 100 micron meshes. The powder is subjected to flotation at pH 10 for 15 minutes.

The cell utilized is the same as that in the foregoing tests. The sample was previously combined with 30 g per tonne of wetting agent.

The collector employed is n-dodecyl-mercaptan.

It is used in a first test in the form of a microemulsion ME1, identical with than of Example 1.

In a second test, the formula of the microemulsion ME2 is:

| | |
|---|---|
| n-dodecyl-mercaptan | 55% |
| nonyl-phenol heptaoxyethylene | 33.75% |
| methyl-isobutyl-carbinol | 4.5% |
| 2-ethyl-hexanol | 6.75% |

Also, a test was carried out with the collector in the form of an ordinary emulsion E constituted by:

| | |
|---|---|
| n-dodecyl-mercaptan | 90% |
| nonyl-phenol-decaoxyethylene | 10% |

The results of this flotation are given in Table 5.

TABLE 5

| Method of introduction | Quantity of collector | | % of metal recovered | |
|---|---|---|---|---|
| | g/T | mol/T | Zn | Pb |
| ME1 | 90 | (0.45) | 97.6 | 92.4 |
| ME1 | 45 | (0.225) | 97.6 | 93.7 |
| ME2 | 90 | (0.45) | 98.2 | 91.5 |
| E | 90 | (0.45) | 54.3 | 68.5 |

This shows that, for zinc and lead, the microemulsion method leads equally to a considerable improvement in the yield of recovery by flotation.

We claim:

1. Collector composition for the flotation of minerals which when added to mineral pulp to be treated forms a microemulsion, comprising a mixture of a compound serving as the flotation collector selected from the group consisting of alkyl mercaptans of 8 to 18 carbon atoms and dialkyl polysulphides of the formula $R—S_x—R'$ in which each of the alkyl groups R and R' have 1 to 14 carbon atoms and x is 2 to 8 with a liquid surfactant and an alcohol of at least 3 carbon atoms co-surfactant, the proportion of surfactant and alcohol being such that the mixture forms a microemulsion in water.

2. Composition according to claim 1, characterized in that the collector compound is a mercaptan of the $HS(CH_2)_nCOOR^a$ type, where n is 1 or 2 and $R^a$ is an alkyl formula group having more than 8 carbon atoms.

3. Composition according to any one of claims 1 to 2, characterized in that the surfactant is a polyoxyalkylene of the formula $R(OR^1)_nOH$, $R^b$ being a $C_1$ to $C_{30}$ alkyl, an aryl, an aryl carrying a $C_1$ to $C_{18}$ linear alkyl, a heterocyclic group or a cycloalkyl, $R^1$ is a $C_1$ to $C_6$ alkylene and n is an integral number from 1 to 12.

4. Composition according to any one of claims 1 to 2, characterized in that the surfactant is a petroleum sulphonate, a fatty alcohol sulphate, an alkylolamide or a quaternary ammonium compound.

5. Composition according to claim 1, characterized by comprising by weight 30 to 60% of the collector compound, 20 to 55% of the surfactant and 5 to 30% of the co-surfactant.

6. Composition according to claim 5, characterized in that the co-surfactant is insoluble in water.

7. Composition according to claim 5 characterized in that the surfactant is a polyoxyalkylene of the formula $R^b(OR^1)_nOH$, $R^b$ being a $C_1$ to $C_{30}$ alkyl, an aryl, an aryl carrying a $C_1$ to $C_{18}$ linear alkyl, a heterocyclic group or a cycloalkyl, $R^1$ is a $C_1$ to $C_6$ alkylene and n is an integer from 1 to 12.

8. Composition according to claim 7 characterized in that the surfactant is a polyethoxylated nonyl phenol, the co-surfactant is isopropyl alcohol and ethyl hexanol, and the collector compound is selected from the group consisting of n-dodecyl mercaptan, t-dodecyl mercaptan, di-t-dodecyl pentasulphide, di-t-nonyl pentasulphide, di-t-dodecyl trisulphide and potassium amylxanthate.

9. Composition according to claim 1 comprising polyethoxylated nonyl phenol, methyl isobutyl carbinol, ethyl hexanol and n-dodecyl mercaptan.

10. Collector composition for the flotation of minerals comprising a microemulsion of a compound serving as the flotation collector selected from the group consisting of alkyl mercaptans of 8 to 18 carbon atoms and dialkyl polysulphides of the formula $R—S_x—R'$ in which each of the alkyl groups R and R' have 1 to 14 carbon atoms and x is 2 to 8, a liquid surfactant, an alcohol having at least 3 carbon atoms co-surfactant, and water.

11. Collector composition according to claim 10 which comprises, by weight, 15 to 30% of the collector compound, 8 to 30% of the surfactant, 2 to 30% of the alcohol and 50 to 70% of water.

12. Composition according to claim 11 in wherein the surfactant is a polyethoxylated nonyl phenol, the alcohol is isopropyl alcohol and ethyl hexanol, and the flotation compound selected from the group consisting of n-dodecyl mercaptan, p-dodecyl mercaptan, di-t-dodecyl pentasulphide, di-t-nonyl pentasulphide, di-t-dodecyl trisulphide and potassium amylxanthate.

* * * * *